US008368496B2

(12) United States Patent
Voss et al.

(10) Patent No.: US 8,368,496 B2
(45) Date of Patent: Feb. 5, 2013

(54) PERMANENT MAGNET HAVING IMPROVED FIELD QUALITY AND APPARATUS EMPLOYING THE SAME

(75) Inventors: Guenter F. Voss, Much (DE); Anthony N. Duryea, Cheswick, PA (US)

(73) Assignee: Monitor Instruments Company, LLC, Cheswick, PA (US)

( * ) Notice: Subject to any disclaimer, the term of this patent is extended or adjusted under 35 U.S.C. 154(b) by 0 days.

(21) Appl. No.: 12/005,336

(22) Filed: Dec. 26, 2007

(65) Prior Publication Data

US 2008/0157907 A1 Jul. 3, 2008

Related U.S. Application Data

(60) Provisional application No. 60/878,277, filed on Jan. 3, 2007.

(51) Int. Cl.
*H01F 7/02* (2006.01)

(52) U.S. Cl. ..... 335/296; 335/306

(58) Field of Classification Search ..... 335/296–306; 250/281–300, 396 ML
See application file for complete search history.

(56) References Cited

U.S. PATENT DOCUMENTS

| | | | | |
|---|---|---|---|---|
| 3,334,264 | A | 8/1967 | Niclas | |
| 3,670,162 | A | 6/1972 | Elmore | |
| 3,996,464 | A | 12/1976 | Fletcher et al. | |
| 4,810,986 | A * | 3/1989 | Leupold | 335/301 |
| 4,994,777 | A * | 2/1991 | Leupold et al. | 335/302 |
| 5,210,413 | A * | 5/1993 | Balzer | 250/298 |
| 5,438,308 | A * | 8/1995 | Leupold et al. | 335/306 |
| 5,805,044 | A * | 9/1998 | Leupold | 335/306 |

OTHER PUBLICATIONS

Rutherford, S.L. et al., "Miniature Sputter-Ion Pump Design Considerations," NASA/JPL Miniature Vacuum Workshop, Jul. 21-22, 1999.

* cited by examiner

*Primary Examiner* — Ramon Barrera
(74) *Attorney, Agent, or Firm* — Eckert Seamans Cherin & Mellott, LLC; Arnold B. Silverman

(57) ABSTRACT

A ring magnet assembly has a generally cylindrical magnet body defining an air gap having an upper end and a lower end. Upper and lower face plates dispose respectively at an upper portion of the ring magnet and lower portion of the ring magnet. The face plates preferably have a high magnetic permeability. A mass analyzer may be disposed within the air gap. An ion generator may be disposed within an air gap of a ring magnetic assembly of the present invention. A pair of vertically-stacked magnetic ring assemblies may be provided. In that embodiment, a mass analyzer may be disposed within one air gap and an ion generator within another.

11 Claims, 10 Drawing Sheets

PERMANENT MAGNET HAVING IMPROVED FIELD QUALITY AND APPARATUS EMPLOYING THE SAME

CROSS-REFERENCE TO RELATED APPLICATION

The present application claims the benefit of United States Provisional Patent Application Ser. No. 60/878,277, filed Jan. 3, 2007, entitled "Permanent Magnet having Improved Field Quality and Apparatus Employing the Same."

BACKGROUND OF THE INVENTION

1. Field of the Invention

The present invention relates to a permanent magnet having improved field quality and apparatus employing the same and more specifically relates to generally cylindrical permanent magnets cooperating with face plates to define a hollow enclosure within which cooperating apparatus components may be placed.

2. Description of the Prior Art

In magnetic instrumentation like mass spectrometers the magnet's size, weight, and precision are generally the parameters which determine mostly cost and performance of the instrument. Though new magnetic materials offered many opportunities to reduce size and weight, the increased requirements in precision on the other hand practically outweigh these benefits. Today's magnets often are still big in size and weight, and precision (mostly uniformity) is always an issue.

A dipole magnet is characterized by two magnetic poles, called north and south pole, between which a magnetic field is established. The simplest form is a bar magnet shown in FIG. 1.

Scientific and technical applications often require a uniform magnetic field within a certain volume that can be represented by parallel magnetic field lines. To approximate this field, different magnetic shapes are known which commonly bring the magnetic poles into opposite positions to form a gap in which inner area the field lines are more or less parallel. Simple forms are the horseshoe (FIG. 2) and the U-shaped magnet, and widely used is the H-shaped magnet shown in FIG. 3. An H-shaped magnet requires two flat magnets of cylindrical or rectangular shape, which are magnetized along the short axis. For an efficient backflow of the magnetic flux, a yoke made of soft steel connects the backsides of each magnet; thus the magnetic flux through the cross-section of the structure resembles the capital letter H which gave the magnet the name.

Though the H-shaped magnet represents one of the most efficient concepts the field in the gap shows imperfections in areas away from the center. Carefully shaped pole pieces can reduce the effect of fringing fields and extend the area of useful uniformity, but they cannot eliminate the fringing fields in principle. This is common for all magnets where the edges of the poles are free in air.

Ring magnets are well known in many applications—obviously new is the consideration of the special boundary conditions for the inside magnetic field. The ring magnet itself generates a magnetic field like a bar magnet, see FIG. 4. The smaller the inner diameter compared to its height, the more it resembles the bar magnet. A ring magnet closed with pole plates reveals an entirely different perspective for the same objective.

In spite of the foregoing known types of permanent magnets, there remains a real and substantial need for improved permanent magnets which can provide for enhanced uniformity of magnetic field, strength of magnetic field and reduced weight and cost of manufacture.

SUMMARY OF THE INVENTION

A ring magnet assembly has a generally cylindrical magnet body defining an air gap having an upper end and a lower end. Upper and lower face plates dispose respectively at an upper portion of the ring magnet and lower portion of the ring magnet. The face plates preferably have a high magnetic permeability. A mass analyzer may be disposed within the air gap. An ion generator may be disposed within an air gap of a ring magnetic assembly of the present invention. A pair of vertically-stacked magnetic ring assemblies may be provided. In that embodiment, a mass analyzer may be disposed within one air gap and an ion generator within another.

It is an object of the present invention to provide an improved permanent magnet which is characterized by enhanced uniformity of field and strength of field.

It is another object of the present invention to provide a permanent magnet design which is characterized by reduced size and weight.

It is another object of the present invention to provide an improved permanent magnet which can be manufactured at a reduced cost.

It is a further object of the present invention to provide a permanent magnet which is cylindrical, hollow and may be structured to contain other apparatus, such as mass spectrometers, for example.

These and other objects of the invention will be more fully understood from the following detailed description of the invention on reference to the illustrations appended hereto.

DESCRIPTION OF THE PREFERRED EMBODIMENTS

A magnet design is described to generate strong, uniform fields inside a cylindrical volume. Compared to common designs used for dipole magnets the torus shape introduced here simplifies manufacturing processes and reduces the number of parts required. The choice of this geometry provides better uniformity and higher field strength than achievable with conventional magnets. Instrumentation like mass spectrometry and NMR instruments will be reduced in size and weight while the performance will be increased.

Figure 5:
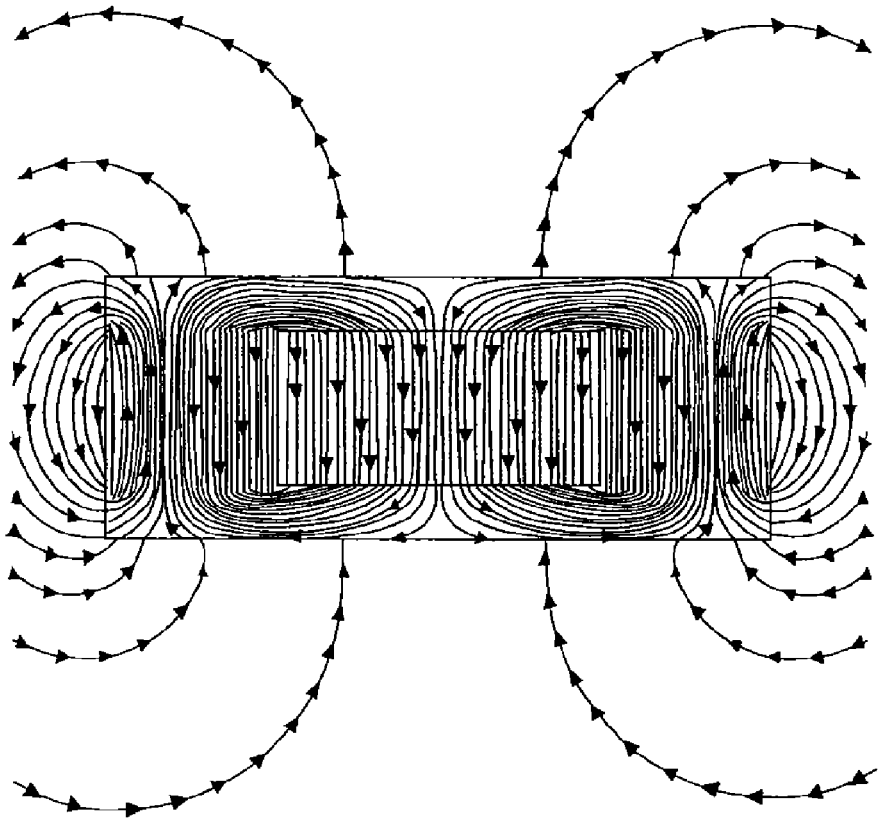
FIG. 5 illustrates a cross-section of a form of ring magnet of the present invention having a pair of magnetic face plates secured thereto.

In FIG. 5, the scenario of fringing fields inside the ring does not occur—a more detailed analysis shows that this is perfectly true for a perfect geometry and infinite permeability of the face plates. In practice, we consider the soft steels like 1010 or 1018 permeabilities between 10,000 and 18,000 which give us a uniformity, that cannot be achieved with an H-shaped magnet of similar size.

Figure 6A:
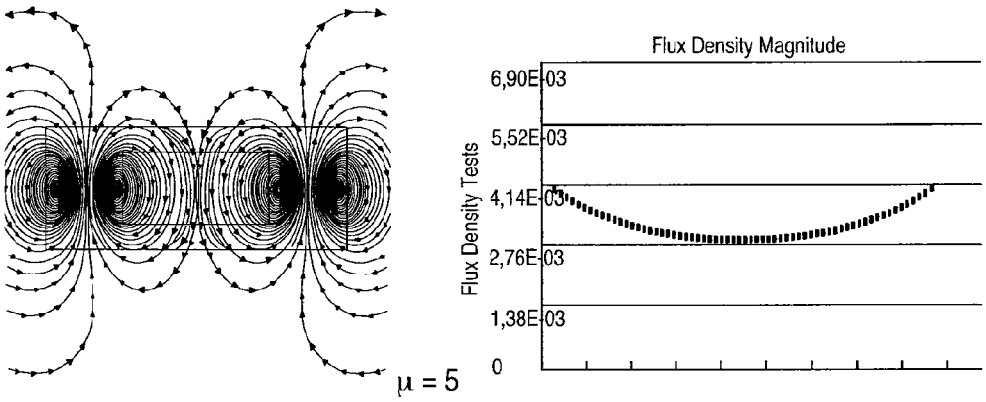
FIGS. 6(*a*)-6(*c*) illustrate cross-sectional views through three ring magnets having face plates and the corresponding plot of flux density magnitude along a diameter as related to face plate permeability. This illustrates the influence of face plate permeability $\mu$ on the uniformity of field.
Figure 6B:
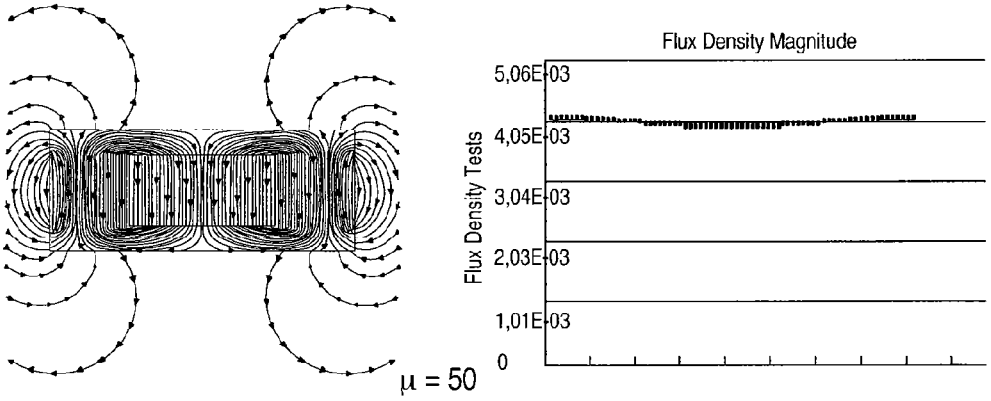
Figure 6C:
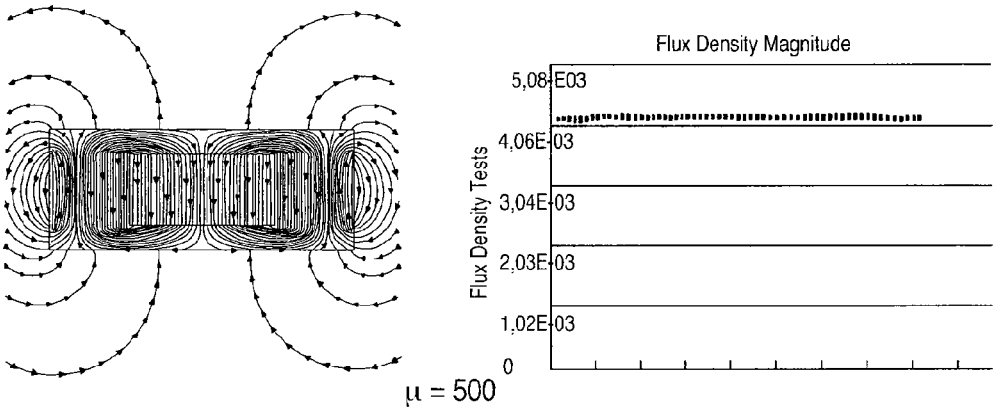
Figure 7:
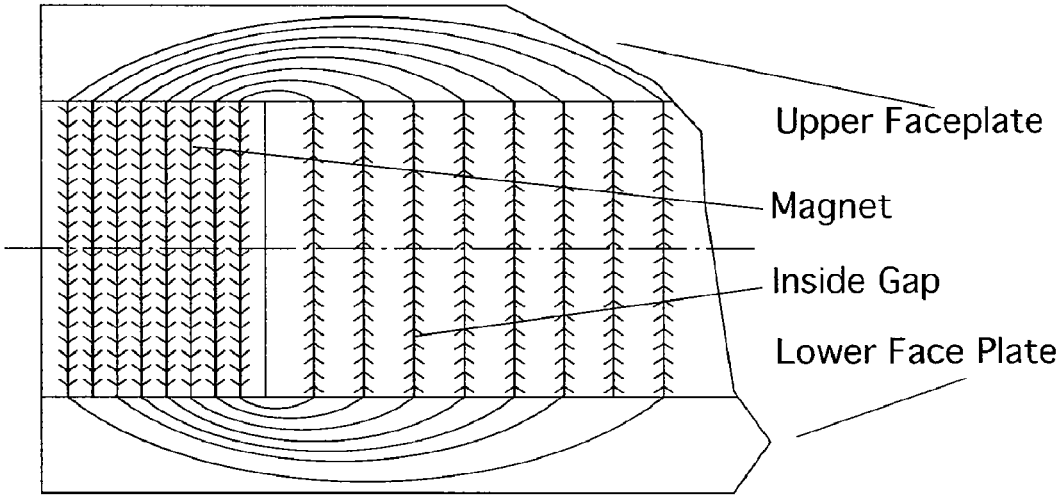
FIG. 7 illustrates schematically the portion of a ring magnet of the present invention provided with face plates and a schematic illustration of the magnetic flux lines.

FIGS. 6(*a*) through 6(*c*) show the gradual differences for different permeabilities.

Figure 4:
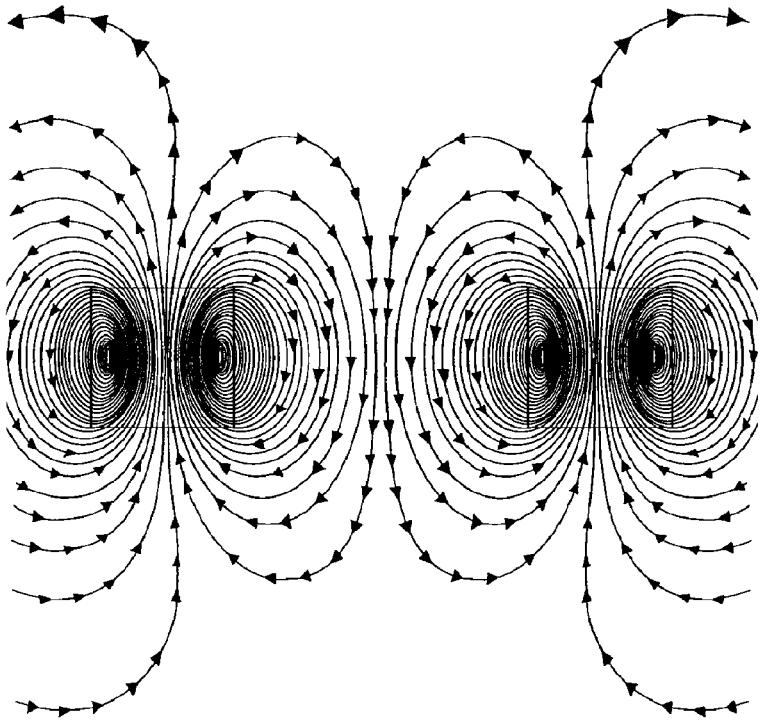
FIG. 4 Prior Art
FIG. 4 illustrates schematically a cross-section through a prior art, generally donut-shaped ring magnet with axial magnetization.

The magnification of the area where the magnet material meets the free space inside the ring magnet (FIG. 4) explains the special properties at this boundary.

Within the magnet's material the field lines are fixed to their locations of microscopic origins, the elementary currents. Thus there is no significant interference with the parts of the field line loops within the gap. Because of the cylindrical symmetry of the design the pattern of the field lines is the same for any other cross-section through the magnet and the only consistent physical solution under these boundary conditions without additional magnetic sources is a uniform field with equidistant field lines.

Non-uniformity if the field may be seen if parts of the face plates are driven into magnetic saturation in strong fields. This can be avoided by the appropriate choice of the material (permeability) and sufficient thickness of the face plate. Using common materials like annealed 1018 steel and NdFeB ring magnets lead to the following example:

| | | |
|---|---|---|
| Magnet dimensions | O.D. = 3" I.D. 1.5" | Thickness 0.75" |
| Magnet exit flux density | B = 4200 Gauss | |
| Face plates dimensions | O.D. = 3" | Thickness = 0.25" |

This generated an inside field of 5,200 Gauss with a relative uniformity of +0.1%.

Figure 8A:
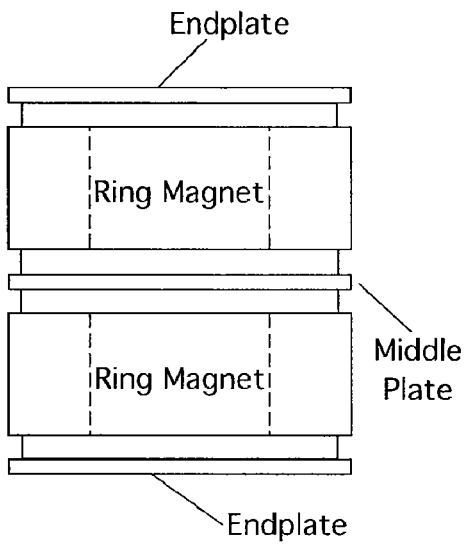
FIGS. 8(*a*) and 8(*b*) illustrate, respectively, an elevational view and cross-sectional view of a pair of permanent ring magnets of the present invention provided with sealed chambers therewithin with cooperating end plates and a middle plate.
Figure 8B:
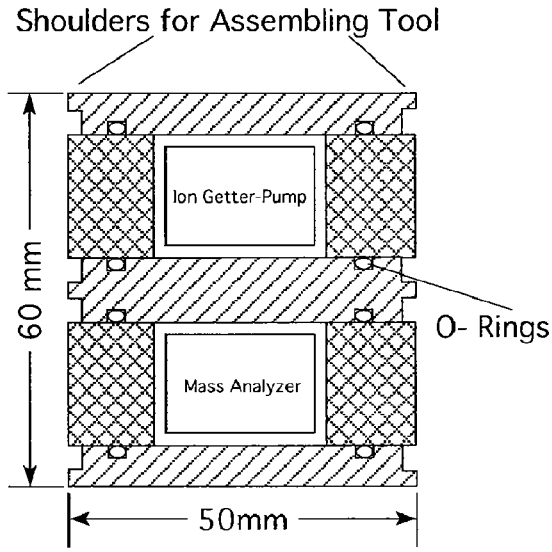

The uniform magnetic area enclosed inside the magnet suggests to use the magnet's interior as a vacuum housing. It can be easily sealed by O-rings or metals like indium and the metal surfaces can be electroplated to keep the out gassing low. The missing vacuum manifold means another significant reduction in size, weight, and particularly in cost. Two and more analyzers or instrumentation can be cascaded easily in common assemblies. FIGS. 8(*a*)-8(*b*) show an example designed for a small mass analyzer in combination with an ion sputter pump.

Ion-getter-pump combinations using one common magnet have been tested in the past, but suffer from the electromagnetic interference of the noisy sputter pump with the sensitive analyzer. The assembly shown in FIGS. 8(*a*)-8(*b*) instead provides virtually perfect shielding of the electric and the magnetic field as well.

Mass spectrometric applications are, for example,

Small sector field mass spectrometers

Figure 10:
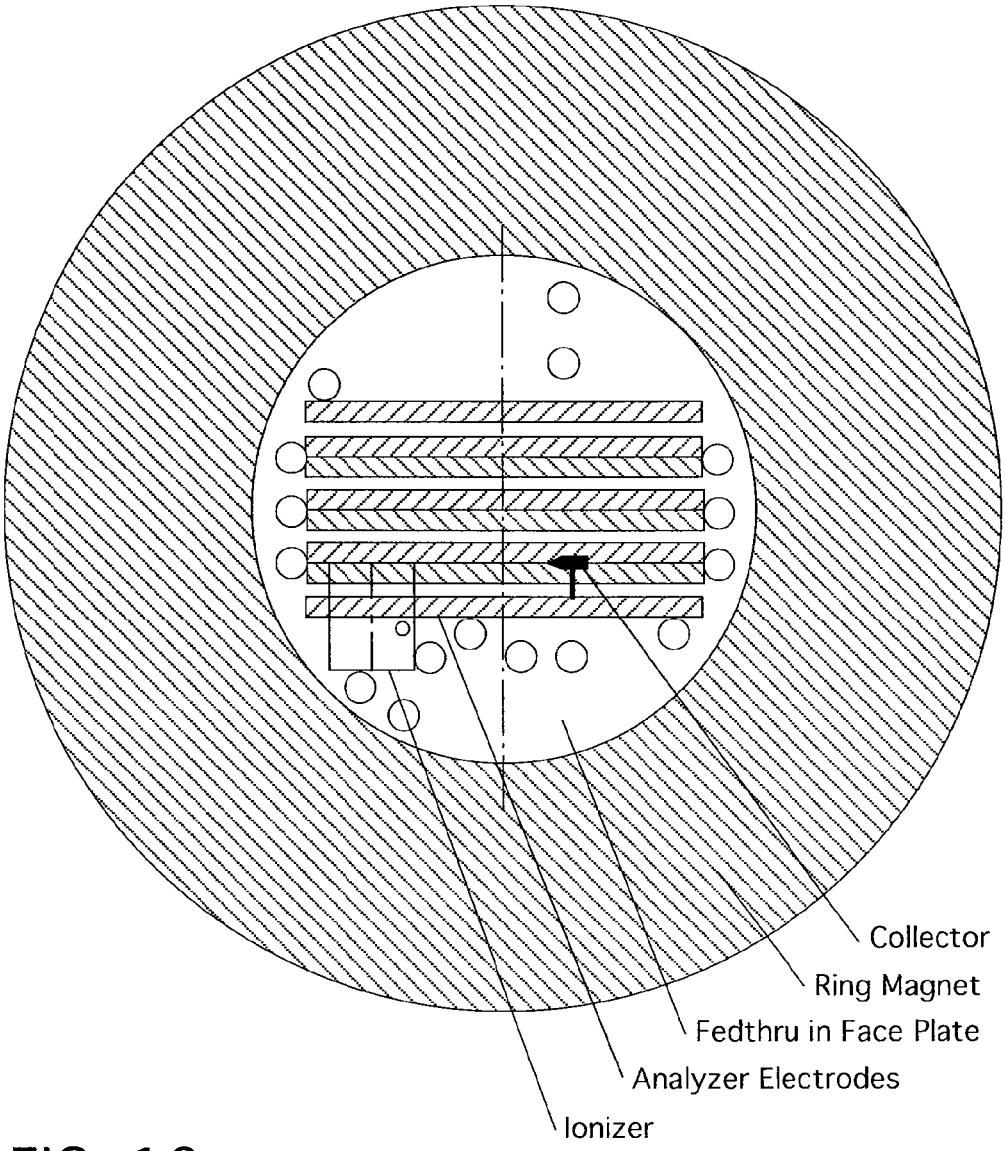
FIG. 10 is a schematic view showing a ring magnet of the present invention with a linear cycloidal mass spectrometer positioned therewithin with the upper face plate removed and the lower face plate in position.

Small to middle sized linear cycloidal mass spectrometers (FIG. 10)

Figure 11:
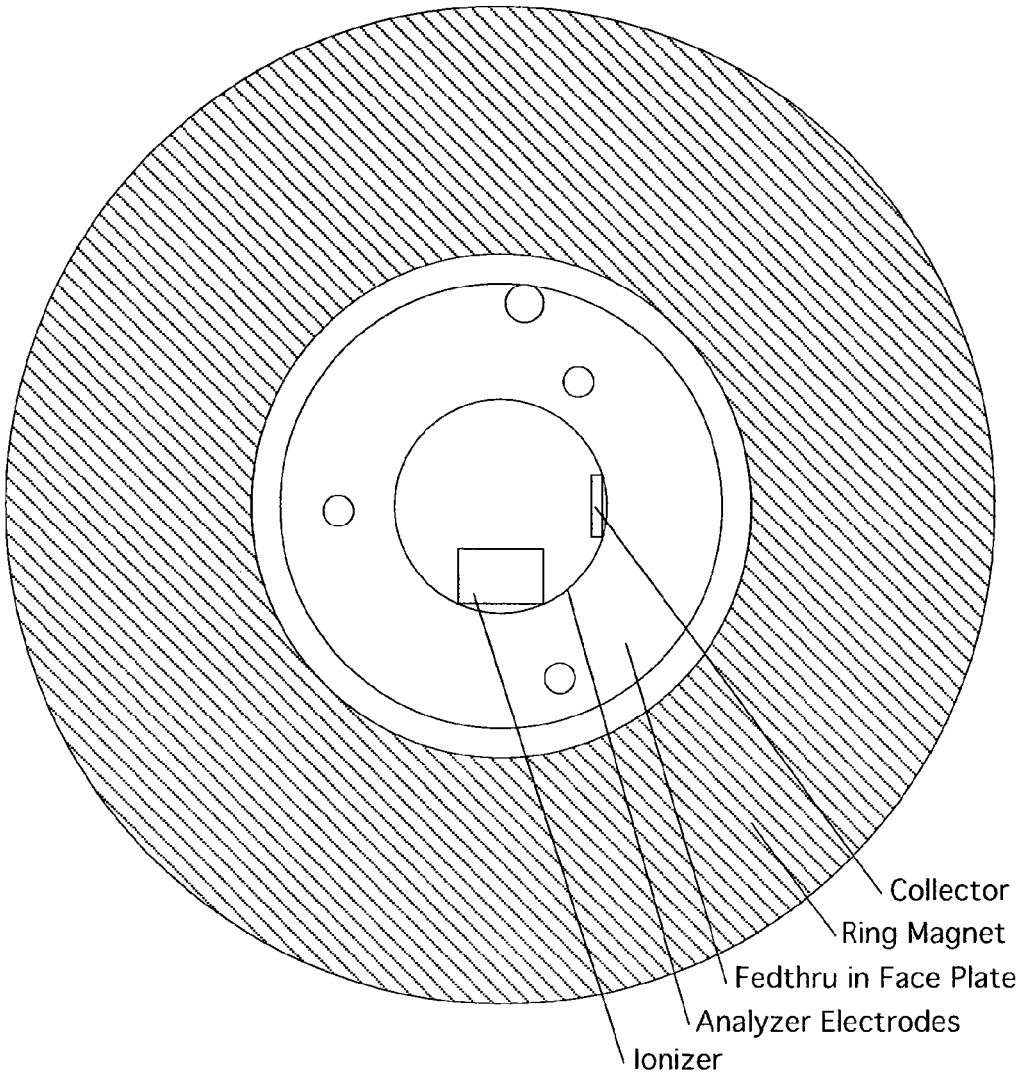
FIG. 11 shows a ring magnet of the present invention with the upper face plate removed and the lower face plate in position and a circular cycloidal mass spectrometer disposed therewithin.

Small to large sized circular cycloidal mass spectrometers (FIG. 11)

The terms "small", "middle", and "large" are a rough description of what has been built up to now. For example:

Realized circular cycloidal analyzers have a diameter of about 70 mm. Thus an instrument with 300 mm diameter is assigned to "large".

Sector field instruments can have extensions of several meters. So 300 mm is assumed to be "small".

Particularly in small ion sputter pumps the choice of the magnet leads to a dilemma: The wide gap, together with small pole face areas, results in bad magnetic fields that limit the length of the anode cylinders and thus the pumping speed and general performance (compare "Miniature Sputter-Ion Pump Design Considerations" by S. L. Rutherford et al., 1999 NASA/JPL Miniature Vacuum Workshop).

Improving the magnet in its U-shape design would dramatically increase size and cost, which cannot be justified for a small and inexpensive pump.

Figure 12:
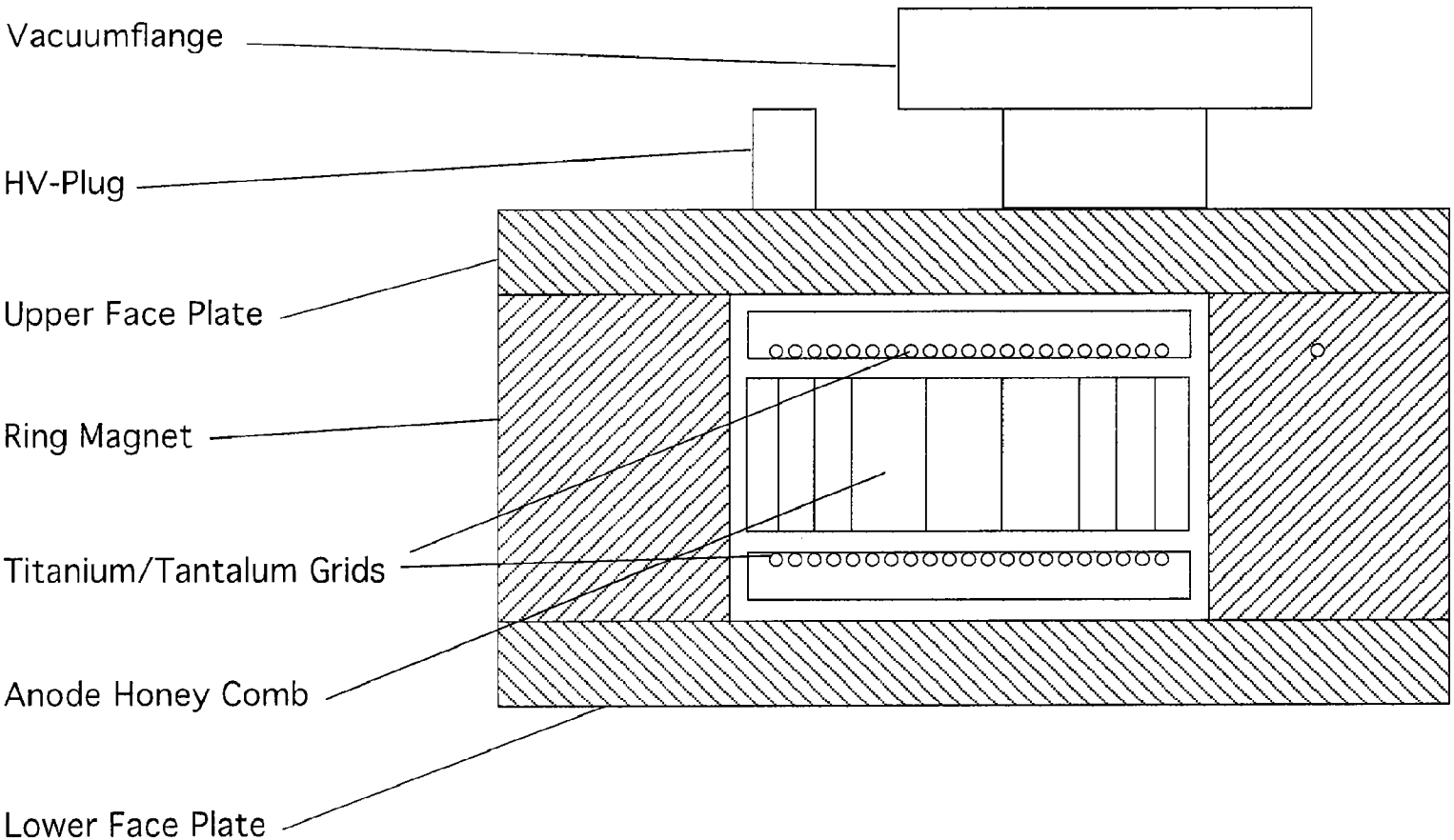
FIG. 12 shows a cross-sectional elevational view of a ring magnet of the present invention with an ion getter triode pump disposed therein.

The ring magnet described is the low cost solution to provide small size and uniform field. An estimate for replacing a standard pump with a pumping speed of 5 l/s by a ring magnet pump with similar electrode sizes gives us an increase in pumping speed of about a factor of 3. FIG. 12 illustrates the principal arrangement.

Applications

The proposed invention provides better fields at lower size and at lower cost. Generally this is interesting in all areas where uniform magnetic fields are necessary. Nonetheless the applications will meet limits in the situation listed below:

(a) The required magnet's size exceeds manufacturing capabilities or reasonable cost.

(b) The access to the magnetic chamber requires major destruction of the plates' and the magnet's symmetry. This may be the case in particle accelerators where the beam chamber must be guided through the magnetic field.

(c) The field strength required is higher than achievable with permanent magnets. The necessary temperature for operation or bake-out exceeds the magnets operation temperature.

Figure 1:
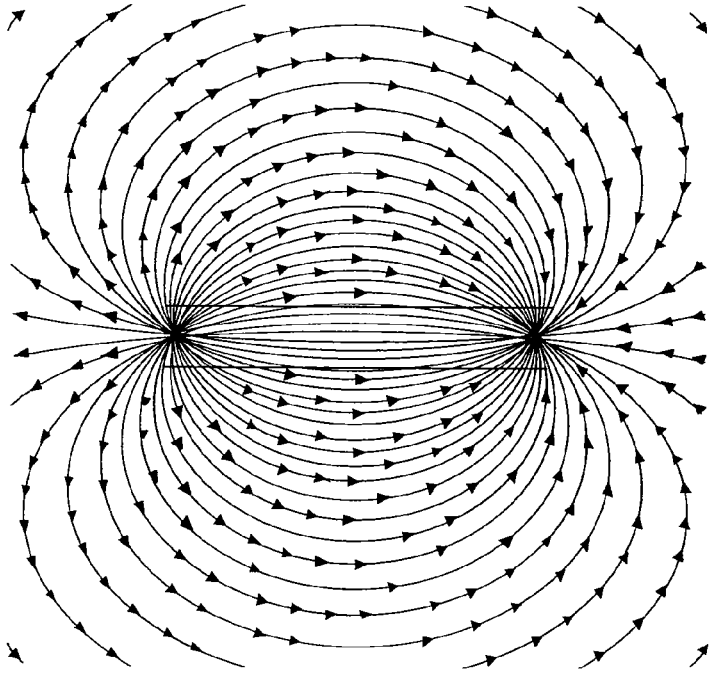
FIG. 1 Prior Art
FIG. 1 schematically illustrates a prior art form of dipole magnet and its associated magnetic field.
Figure 2:
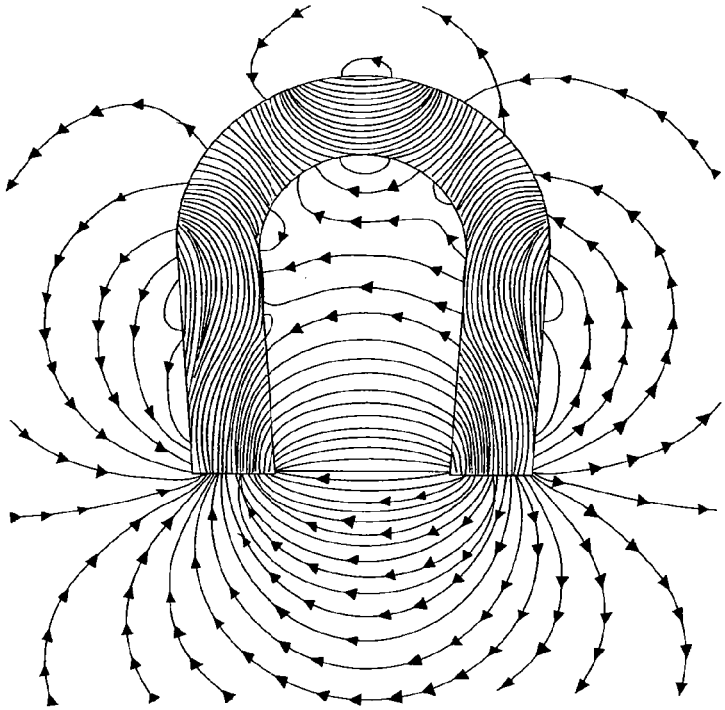
FIG. 2 Prior Art
FIG. 2 schematically illustrates a prior art form of horseshoe magnet and its associated magnetic field.
Figure 3:
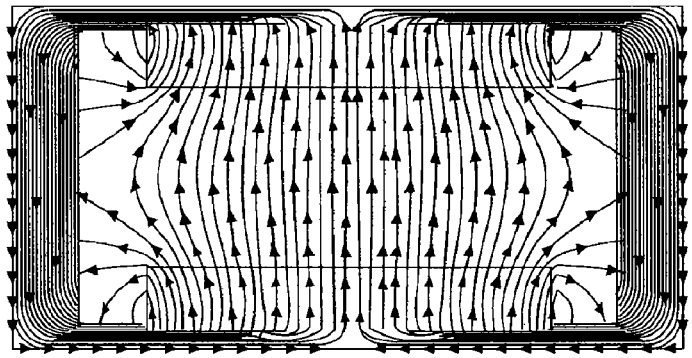
FIG. 3 Prior Art
FIG. 3 illustrates a prior art form of H-shaped dipole magnet and its associated field

A positive indication for realization is obvious in these areas:

(a) Small size, low weight (b) Instrument cost reduction (b) Wide and extremely wide gap widths The need of a wide gap aggravates the difficulties in conventional magnet design. An H-shaped magnet is assumed, as seen in FIG. 3, with a gap width of 25 mm and a weight of 5 kg. If the magnet's design is changed to increase the gap width by a factor of 10 (250 mm), requesting the same field uniformity and flux density, the magnet's weight can easily reach several tons (compare for example U.S. Pat. No. 3,670,162). The increase of the gap makes adjustments in all three space coordinates necessary.

Figure 9A:
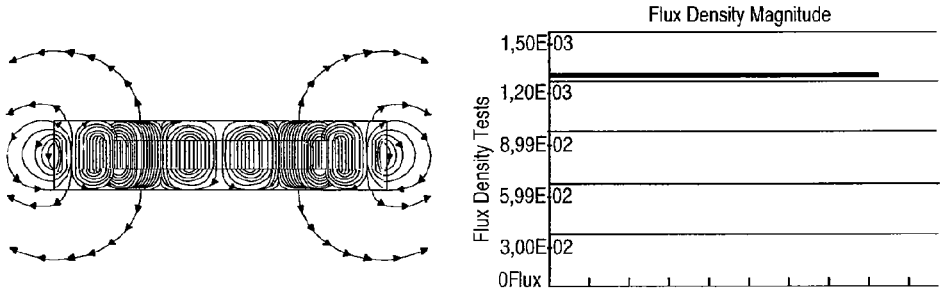
FIGS. 9(*a*)-9(*c*) illustrate three ring magnets of the present invention of varying heights with the corresponding flux density magnitude plots for each.
Figure 9B:
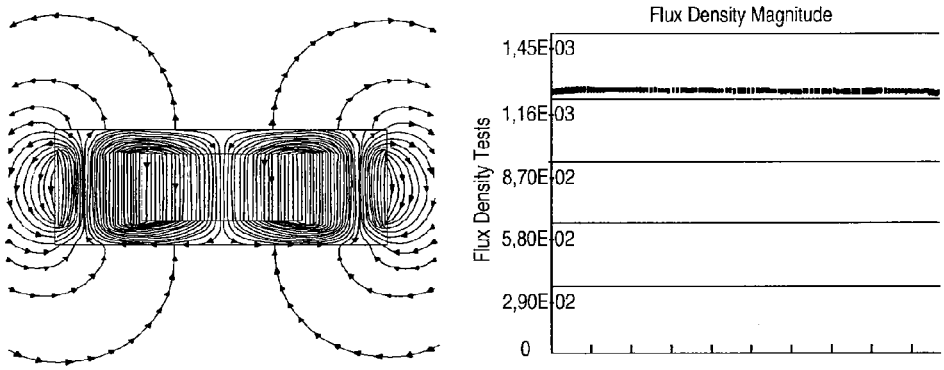
Figure 9C:
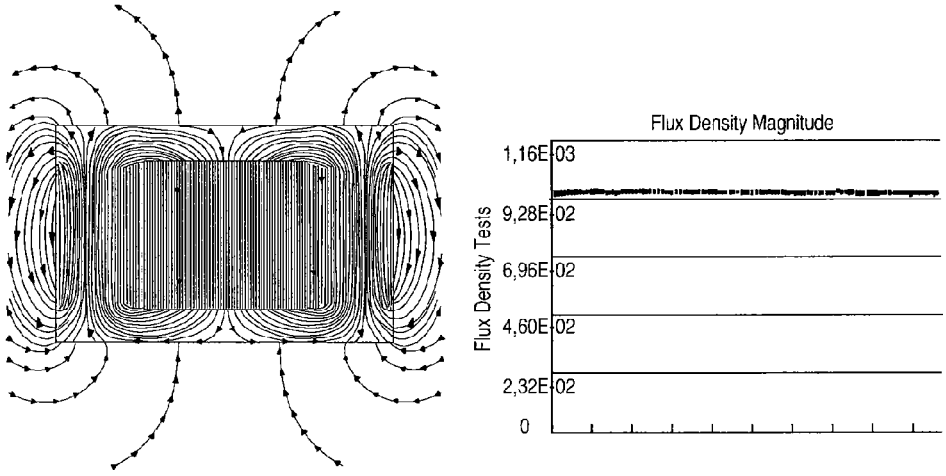

An entirely different result describes the same scenario for the ring magnets described before. In the ideal case, very high permeability of the face plates and uniform properties of the magnet's material, the uniformity and the flux density show only a slight dependence on the height of the ring magnet—in a first approximation the flux density is constant up to certain variations of the height. (See FIGS. 9(*a*)-9(*c*).)

A ring magnet with 50 mm o.d. 25 mm i.d. and a gap width of 25 mm i.d. weights about 400 grams, including two face plates. Increasing the gap to 250 mm needs another 9 ring magnets, each 300 grams, which bring the magnet weight to a total of 31 kg.

Whereas particular embodiments of the invention have been described herein for purposes of illustration, it will be evident to those skilled in the art that numerous variations of the details may be made without departing from the invention as set forth in the appended claims.

The invention claimed is:

1. A ring magnet assembly comprising a ring magnet body defining an air gap having an upper end and a lower end, a magnetic field extending from one end of said gap upper end and said gap lower end to the other said gap upper end and said gap lower end, an upper face plate disposed at the upper end of said magnet, a lower face plate disposed at a lower end of said magnet, said upper and lower face plates cooperating with said ring magnet body to define a vacuum housing, said face plates being composed of a magnetic material, said face plates having a permeability of about 10,000 to 18,000, said ring magnet assembly being characterized by having a substantially uniform magnetic field extending from one of said gap upper end and said gap lower end to the other said gap upper end and said gap lower end with equidistant field lines, and said ring magnet assembly is structured to provide said substantially uniform magnetic field without requiring the use of externally disposed cladding magnets.

2. The ring magnet assembly of claim 1 including said face plates being composed of steel.

3. The ring magnet assembly of claim 1 including said face plates having high permeability.

4. The ring magnet assembly of claim 1 including said ring magnet assembly characterized by a flux density which remains substantially the same regardless of the height of said ring magnet.

5. The ring magnet assembly of claim 1 including a mass analyzer disposed within said air gap.

6. The ring magnet assembly of claim 5 including said mass analyzer being a mass spectrometer.

7. The ring magnet assembly of claim 6 including said mass spectrometer being selected from the group consisting of a circular cycloidal mass spectrometer and a time of flight mass spectrometer.

8. The ring magnet assembly of claim 6 wherein said mass spectrometer comprises a linear cycloidal spectrometer.

9. The ring magnet assembly of claim 1 including an ion pump disposed within said gap.

10. Ring magnet assemblies comprising a pair of ring magnet assemblies each having a ring magnet body defining an air gap having an upper end and lower end, said pair of ring magnet assemblies stacked generally vertically having an upper ring magnet assembly and a lower ring magnet assembly with a magnetic middle plate disposed therebetween, an upper face plate disposed at the upper end of said upper ring magnet assembly, a lower face plate disposed at a lower end of said lower ring magnet assembly, the upper and lower magnet assemblies and said magnetic middle plate cooperating to define a pair of vacuum housings, and the ring magnet assemblies each being characterized by having a substantially uniform magnetic field with equidistant field lines from one end of said gap upper end and said gap lower end to the other said gap upper end and said gap lower end between said middle plate and said upper face plate or said lower face plate.

11. The ring magnet assembly of claim 10 including one said ring magnet assembly containing a mass analyzer, and another said ring magnet assembly containing an ion pump.

* * * * *